United States Patent [19]

Shaw

[11] Patent Number: 4,587,933

[45] Date of Patent: May 13, 1986

[54] CYLINDER BLOCK FOR INTERNAL COMBUSTION ENGINE

[75] Inventor: Terrence M. Shaw, Columbus, Ind.

[73] Assignee: Cummins Engine Company, Inc., Columbus, Ind.

[21] Appl. No.: 525,255

[22] Filed: Aug. 19, 1983

Related U.S. Application Data

[63] Continuation-in-part of Ser. No. 339,126, Jan. 13, 1982, abandoned, which is a continuation of Ser. No. 104,097, Dec. 17, 1979, abandoned.

[51] Int. Cl.[4] ..... F02F 1/36

[52] U.S. Cl. ..... 123/41.67; 123/41.81

[58] Field of Search ..... 123/41.67, 41.72, 41.74, 123/41.81, 193 C, 193 CH

[56] References Cited

U.S. PATENT DOCUMENTS

| | | | |
|---|---|---|---|
| 1,416,170 | 5/1922 | Cattaneo | 123/41.72 |
| 1,529,812 | 3/1925 | Reinke . | |
| 1,649,370 | 11/1927 | Spencer | 123/41.74 |
| 1,968,110 | 6/1934 | Walker | 123/193 CH |
| 2,444,963 | 7/1948 | Taylor | 123/41.76 |
| 2,681,050 | 6/1954 | Shnürle et al. | 123/41.74 |
| 2,817,327 | 12/1957 | Brenneke | 123/41.74 |
| 3,161,182 | 12/1964 | Albinson et al. . | |
| 3,173,407 | 3/1965 | Sampietro et al. | 123/41.74 |
| 3,340,774 | 9/1967 | Brenneke | 123/41.74 |
| 3,528,397 | 9/1970 | Seifert | 123/41.72 |
| 4,066,057 | 1/1978 | Hale | 123/41.74 |
| 4,136,648 | 1/1979 | Ernest | 123/193 CH |
| 4,329,947 | 5/1982 | Ishihara | 123/193 C |
| 4,343,267 | 8/1982 | Shaw | 123/41.74 |
| 4,419,970 | 12/1983 | Shaw | 123/41.74 |

FOREIGN PATENT DOCUMENTS

| | | | |
|---|---|---|---|
| 803449 | 4/1951 | Fed. Rep. of Germany | 123/41.72 |
| 1576713 | 6/1970 | Fed. Rep. of Germany | 123/41.72 |
| 992082 | 7/1951 | France | 123/41.74 |
| 2031157 | 11/1970 | France | 123/193 C |
| 1244800 | 9/1971 | United Kingdom | 123/193 C |

*Primary Examiner*—Magdalen Y. C. Moy
*Assistant Examiner*—David A. Okonsky
*Attorney, Agent, or Firm*—Neuman, Williams Anderson & Olson

[57] ABSTRACT

A cylinder block for an internal combustion engine is provided which includes a plurality of relatively spaced free-standing cylinder tubes disposed within a cooling jacket formed in the block. The cylinder tubes are connectedly supported by, and extend upwardly from, the floor section of the cooling jacket. The jacket floor section is reinforced by at least one elongated rib-like member which is integral with and depends from the underside of the floor section and is located between adjacent cylinder tubes. Each rib-like member substantially spans the distance between opposing walls that form, in part, the cooling jacket, and is remote from a cavity within the jacket through which a coolant is caused to circulate during operation of the engine. Bolt receiving means of the cylinder block are positioned so that, when restraining bolts are introduced and tightened to secure a cylinder head to the block, substantially uniform support of the cylinder tubes from their lower portion is achieved. Lateral movement of the upper ends of the cylinder tubes is restricted by struts extending radially from the cylinder tubes and connected to the walls of the cooling jacket.

9 Claims, 4 Drawing Figures

FIG. 1
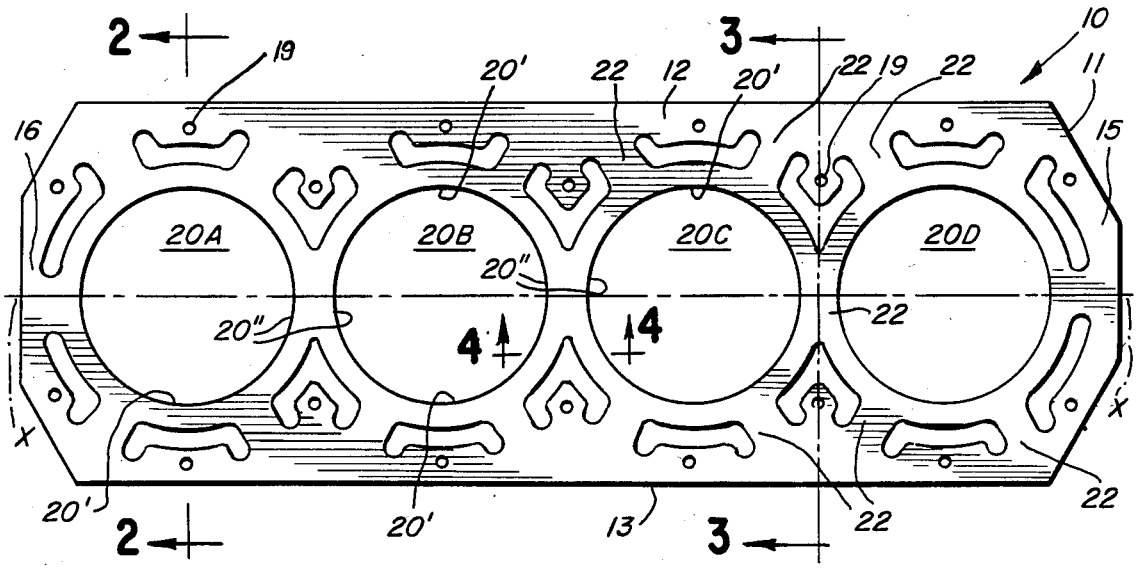
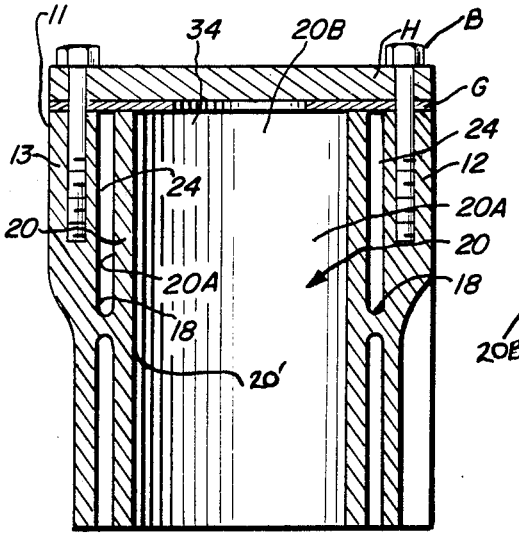
FIG. 2
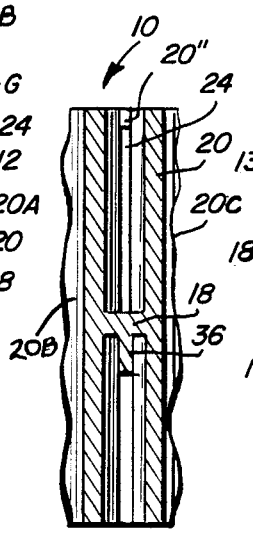
FIG. 4
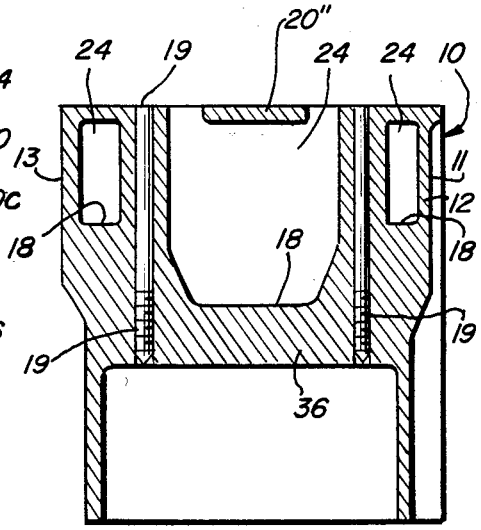
FIG. 3

CYLINDER BLOCK FOR INTERNAL COMBUSTION ENGINE

BACKGROUND OF THE INVENTION

This application is a continuation-in-part of application Ser. No. 339,126 filed on Jan. 13, 1982, now abandoned. Application Ser. No. 339,126 is a continuation of application Ser. No. 104,097 filed on Dec. 17, 1979, now abandoned.

Heretofore various cylinder blocks have been provided for high-compression internal combustion engines; however, because of certain inherent design characteristics they have been beset with one or more of the following shortcomings: (a) difficulty has been encountered in obtaining a proper seal between the top surface of the cylinder block and the cylinder head and head gasket which overlie same; (b) the cylinder tubes formed within the block are highly susceptible to axial and radial distortions caused by the substantial and nonuniform compressive forces exerted on the upper ends of the cylinder tubes when the head and gasket are assembled on the block; (c) the tube distortions cause an uneven distribution of the sealing load exerted on the ends of the cylinder tubes and result in uneven and excessive seal wear; (d) ineffective cooling of the cylinder tubes by reason of obstructed flow of the coolant through the cooling jacket formed within the block and surrounding the tubes; and (e) the cylinder block construction is bulky and excessively heavy.

SUMMARY OF THE INVENTION

Thus, it is an object of the invention to provide an improved cylinder block which avoids the aforenoted shortcomings.

It is also an object to provide an improved cylinder block having a plurality of cylinder tubes formed therein and supported with substantial uniformity by the floor of the block.

It is a further object to provide an improved cylinder block having a plurality of cylinder tubes formed therein, wherein an effective reinforcing means is provided at the floor of the block which substantially reduces axial distortions of the tubes and does not impede coolant flow through the cooling jacket.

It is a further object to provide an improved cylinder block having the bolt receiving means of the block positioned so that when a cylinder head is secured to the block the cylinder tubes are supported with substantial uniformity.

It is still a further object to provide an improved cylinder block wherein the upper ends of the freestanding cylinder tubes are restrained from lateral movement during operation of the engine.

Further and additional objects will appear from the description, accompanying drawings and appended claims.

In accordance with an embodiment of the invention, a cylinder block for an internal combustion engine is provided which includes a cooling jacket having opposing walls and a floor section and a plurality of relatively spaced cylinder tubes extending upwardly from the floor section into the cooling jacket. An elongated reinforcing rib is integral with and subtends the jacket floor section and has at least one end of the rib connected to a jacket wall. A cylinder head overlies the upper surface of the cylinder block and is securerd thereto by a plurality of bolts. Bolt receiving means are provided in the block and positioned so that when the cylinder head is secured to the block, the cylinder tubes are supported from their lower portions with substantial uniformity. A plurality of elongated struts extend radially from the upper portion of the cylinder tubes and are connected to the cooling jacket walls for restraining movement of the cylinder tubes in the lateral direction.

BRIEF DESCRIPTION OF THE DRAWINGS

FIG. 1 is a top plan view of one form of the improved cylinder block per se and showing the upper edges of the cooling jacket walls and the upper ends of the cylinder tubes disposed within the jacket.

FIG. 2 is a cross-sectional view taken along the line 2—2 of FIG. 1 and showing a conventional gasket and cylinder head assembled on the top surface of the block.

FIG. 3 is a cross-sectional view taken along the line 3—3 of FIG. 1.

FIG. 4 is a cross-sectional view taken along the line 4—4 of FIG. 1.

DESCRIPTION OF THE ILLUSTRATED EMBODIMENT

Referring to FIGS. 1–4, one embodiment of the improved cylinder block 10 is shown which includes a cooling jacket 11 having, in this instance, opposing side walls 12 and 13 which are interconnected to opposing end walls 15 and 16, and a floor section 18. A plurality of relatively spaced cylinder tubes 20 are disposed within the area delimited by the jacket walls and extend upwardly from and are connected to the jacket floor section 18. In the illustrated embodiment, four tubes 20A, B, C and D are arranged in an in-line relation. It is to be understood, of course, that the number and relative location of the tubes may vary from that shown. Further, the tubes 20 may include a replaceable inner liner or may be entirely replaceable themselves. The upper ends of the tubes as shown are in generally coplanar relation with the top edges of the walls and define the top surface of the cylinder block 10. The cooling jacket may have a variety of shapes, and the upper ends of the cylinder tubes need not be in coplanar relation with one another or the top edges of the jacket walls, so long as the cylinder tubes and jacket walls appropriately mate with the cylinder head. It is desirable that the jacket walls, as well as the cylinder tubes, be load bearing so that the full force of the combustion event is not entirely absorbed by the cylinder tubes. The block 10 is preferably cast as a one-piece unit and the tubes may be bored and machined as required. Alternatively, portions of the cylinder block may be cast or fabricated separately and fastened together as by welding or restraining bolts. FIGS. 1–4 depict for clarity a unitary one-piece cylinder block construction.

Referring to FIG. 2, block 10 is shown assembled with a conventional cylinder head gasket G which overlies in superposed relation the top surface of the block. Overlying the gasket is a cylinder head H which is secured to the block by a plurality of cylinder head restraining bolts B. The bolts are threaded into a corresponding number of internally threaded bores or openings 19 formed in the block top surface. The bolts are drawn up tight on the block causing the head H to compress the gasket G against the block top surface, which is the illustrated embodiment and is substantially defined by the upper ends of the cylinder tubes and the top edges of the jacket walls. Thus, a sealed space or cavity 24 is formed through which a coolant (e.g., water) is caused to circulate during engine operation for the transfer of excess heat from the block to an external heat exchanger not shown. Flow of the coolant through the jacket is obtained by a pump, also not shown. The cavity 24 normally extends substantially the full length of the block.

The head H also coacts with the upper ends of the cylinder tubes and the piston heads, reciprocally mounted within the tubes, to form a combustion chamber 34 for each cylinder. The chamber 34 is formed when the piston head is at or near its top dead center as is well understood in the art. Where the block is used in a high-compression engine, it is important that the gasket provide an adequate seal against the high pressures generated within the chambers 34 during operation of the engine.

The cylinder tubes 20 are primarily supported at their bottom portions by the floor section 18, which also serves as the bottom of cavity 24. Because of the high compressive forces exerted on the block top surface by the head H to attain the desired seal, the tubes are susceptible to axial distortions which are resisted primarily by the floor section 18.

Those portions 20' of the cylinder tubes 20A–D proximate the jacket walls are connected to the latter through short spans of the floor section, and thus, normally are provided by the walls with greater axial support than those portions 20" of the cylinder tubes more distant from the jacket walls (i.e., those portions disposed along the longitudinal centerline X—X of the block), thereby resulting in a substantial variation in tube support compliance. The improved block construction is intended primarily to minimize this differential in tube support compliance and thereby extend the useful seal life, improve seal efficiency, more uniformly distribute the seal load throughout the block top surface, promote more even cylinder and piston ring wear, and significantly reduce engine maintenance costs.

In the improved block 10, elongated support ribs 36 are provided which subtend and are integral with the floor section 18. Each rib is located between an adjacent pair of tubes 20A–B; 20B–C; and 20C–D and may be conveniently cast within the block 10 as an integral part of the adjacent tubes. Each rib 36 extends generally transversely across the width of the block 10 and interconnects the opposing side walls 12 and 13. Rib 36 preferably has a width (narrowness) comparable to the tube wall thickness and a depth dimension substantially greater than the tube wall thickness. The ribs combine with the normal thickness of the floor section 18 to provide effective and needed axial support to the tube section 20" and yet does not interfere with coolant flow within the cavity 24 because the ribs are located outside the cooling jacket 11, see FIG. 4. Moreover, in view of the narrowness of each of the ribs, there is no substantial increase in the overall engine weight. Accordingly, depending upon other design parameters, it may be possible to make the jacket floor thinner, to compensate for the added material necessary for the support ribs.

A cantilevered rib that partially spans the distance between the jacket side walls and has only one end thereof connected to one of the side walls may be used and would provide additional support to tube portions 20", but would not be as effective in this regard as a rib which has its ends connected to both of the opposing side walls.

As thus far described, the improved block 10 includes cylinder tubes 20A–D that are principally axially supported near their bottom portions by the floor section 18 and transverse ribs 36. By supporting the cylinder tubes near their bottom portions, the load exerted on the top of the cylinder tubes when the cylinder head H is secured to the block 10 is more uniform, thus prolonging the life of gasket G and reducing the opportunity for leaks at the interface between the gasket and the tops of the cylinder tubes. To further enhance the uniform distribution of loading forces at the tops of the cylinder tubes 20A–D, the threaded bolt bores 19 are positioned in the block 10 so that, when the restraining bolts B are tightened to secure the cylinder head H to the block 10, the loading force transmitted to the connection between the floor section 18 and the bottom portions of the cylinder tubes 20A–D is substantially even around the perimeter of the tubes.

Uniform support of the cylinder tubes 20A–D by proper placement of the bores 19 for the restraining bolts B may be accomplished with various cylinder head bolt patterns. In a four-bolt pattern, wherein the bolts are positioned in a square pattern surrounding the cylinder tube, the cylinder tube may be evenly supported by symmetrically positioning the threaded bolt bores with respect to the axis of the tube. For example, the threaded bolt bores may be located in the lower portion of the block in or near the floor section of the water jacket, equidistant from the connection between the jacket floor and the cylinder tube, or the bores may be located in bosses on the jacket side walls, again in a symmetrical manner with respect to the cylinder tube.

However, for many diesel and other high compression engines, more than four head bolts per cylinder are normally required to ensure adequate head gasket sealing. Thus, a six-bolt pattern is often utilized; the embodiment of the present engine as shown in the Figures reflects the use of a six-bolt pattern. In this pattern, the bolt placement may not be radially symmetric with respect to the connection between the cylinder tube and the water jacket floor. This is because closely spaced cylinder tubes do not permit the bolts to be located as near to the centerline X—X of the cylinder tubes as a symmetric bolt spacing would require. Consequently, if the bolts in a six-bolt pattern were all of the same length and threaded into bores in the water jacket floor or bosses on the jacket walls, the sides of the cylinder tubes would experience a greater support load than the portions of the tubes near the centerline. Even if the bolt pattern were symmetric with respect to a cylinder tube, uneven support of the cylinder tube may result where the tubes are spaced so that bolt patterns of adjacent tubes must share bolts in the area between the tubes.

In the embodiment shown in the Figures, uniform support of the cylinder tubes 20A–D is obtained with the six-bolt pattern by varying the length of the cylinder head bolts B and thus the location of their threaded receiving bores 19 in the block 10. First, the bolts nearest the centerline X—X of the block 10 extend to and engage the floor 18 of the water jacket itself. Preferably the threaded receiving bores 19 for these long bolts are located in reinforcing ribs 36, as shown in FIG. 3, for maximum support of the cylinder tubes 20A–D along the centerline X—X. Note that if other bolt patterns are used, it would sti11 be desirable to locate the threaded bolt bores in the jacket floor 18, and preferably the ribs 36, where bolts in the pattern are located between adjacent cylinder tubes. Second, shorter bolts located alongside the cylinder tubes are engaged by threaded receiving bores 19 at a point removed from the connection between the floor 18 and the cylinder tubes 20. In FIG. 2, the threaded bores 19 for the bolts B alongside the tubes are located on the water jacket walls themselves. By so locating the threaded receiving bores for the shorter side bolts, the support load generated by the side bolts when they are tightened is partially dispersed through the jacket walls. Thus, the support load directly exerted on the sides of the cylinder tubes is decreased somewhat to approximately match the centerline support of the tubes, thereby achieving the goal of uniform cylinder tube support. A similar use of varying cylinder head bolt lengths and placement of the bolt receiving means can be made for other bolt patterns to obtain uniform cylinder tube support.

While the invention provides for uniform axial support of the cylinder tubes 20A–D from their lower portions, provision should be made to restrain radial or lateral movement of the upper portion of the cylinder tubes during operation of the engine. At each combustion event during engine operation, the upper portion of a cylinder tube rapidly expands and contracts. Wear of the head gasket G owing to this movement of the upper cylinder tube portion leads to premature failure of the gasket seal. One way, heretofore, to restrict such movement is to provide a deck spanning the upper portion of the cylinder tubes and the water jacket walls, which deck solidly anchors the upper end of the tubes with respect to the walls of the cylinder block. Several problems are associated with the use of such a deck in the present invention. Most importantly, the full top deck would distort the otherwise uniform lower support loading of the cylinder tubes. A full top deck would provide a strong connection between the tops of the cylinder tubes and the cylinder head bolt bosses to which the deck is attached, but would be more compliant in areas away from the bolt bosses. Consequently, the cylinder tubes would be supported axially by the top deck as well as by the water jacket floor 18, but with uneven support. A further problem associated with the use of a full deck to restrain lateral cylinder tube movement is that the cooling of the cylinder tubes at their upper portion is severely impeded.

In the embodiment of the invention shown in the Figures, the advantages of the top deck construction are obtained without the above-noted disadvantages by the use of webs or struts 22 to restrain lateral movement of the upper portions of the cylinder tubes 20A–D. The struts 22 extend radially from the cylinder tubes 20 and are connected to the water jacket walls 12, 13, 15, 16; see FIG. 1. To minimize any axial support of the cylinder tubes by the radial struts 22, the struts are of minimum thickness—generally of a thickness similar to that of a water jacket wall, for castability reasons—and maximum length. Further, the struts 22 preferably do not connect to bolt bosses on the jacket walls, some of which bosses, as in the six-bolt pattern shown, may be quite close to the cylinder tubes. Such a short strut connection with bolt bosses would tend to provide an undesirable amount of axial support for the cylinder tubes at their upper portion. However, a short strut connection between adjacent tubes is permissible. The centerline portion 20″ of the cylinder tubes 20 is loaded evenly when the cylinder head is secured to the block, so that a centerline strut would simply move with the centerline X—X of the cylinder tubes and not influence the axial loading of the tubes. To eliminate any axial support of the cylinder tubes 20 by the struts 22, the struts could be supported by their connection to the jacket walls and left unattached to the tubes, but in close proximity to the tubes so as to restrict the radial movement of the tubes. This configuration is particularly advantageous in cylinder block constructions featuring the use of replaceable cylinder tubes.

In the Figures, the radial struts 22 are shown located at the very top of the block 10. This arrangement provides the maximum protection for the head gasket G by restraining radial movement of the top edges of the cylinder tubes 20, which edges are in contact with the gasket. Below the struts 22, however, the cylinder tubes 20 are not restricted in their tendency to bulge as a consequence of the combustion event during engine operation. Left uncorrected, this tendency of the tubes to bulge may cause premature failure of the gasket seal owing to the recurring distortion of the top rim of the cylinder tube, material fatigue in the tubes themselves and deterioration of the piston rings within the tubes. The bulging effect can be minimized, however, by locating the struts 22 lower in the block 10, at the level of the upper portion of the cylinder tubes 20 where maximum combustion pressure occurs. To correct both the bulging effect and radial movement of the top edges of the cylinder tubes, two or more tiers of radial struts as described may be provided.

While a specific embodiment has been illustrated and described, it is to be understood, of course, that the invention is not intended to be limited thereto. Variations in size, number, and general location of the support ribs 36 are contemplated and are dependent upon the designed operating chracteristics of the engine. Similarly, the number and specific location of restraining bolts B and receiving bores 19 may vary depending upon design considerations and the combustion pressures involved.

What is claimed is:

1. In an internal combustion engine, a cylinder block having a cylinder head removably secured thereto by a plurality of restraining bolts, said block comprising a cooling jacket having interconnected opposing load-bearing side and end walls and a floor section; a cylinder tube portion located substantially within said cooling jacket and comprising a plurality of relatively spaced substantially free-standing cylinder tubes supported by and perforating said floor section; said tubes, side walls, end walls and floor section being adapted to coact with the cylinder head to form a cavity through which a coolant is adapted to circulate; an elongated reinforcing rib disposed outside said cavity, said rib integral with and projecting downwardly from said floor section and having at least a portion thereof extending intermediate adjacent cylinder tubes, said portion having a lowermost free edge; means for receiving said restraining bolts and being positioned relative to said cylinder tubes for providing substantially uniform perimetrical support of said tubes when said restraining bolts are tightened to secure the head to the block; and means for substantially restricting radial movement of the upper portion of said cylinder tubes, said movement restricting means comprising a plurality of elongated struts substantially radially extending from said cylinder tubes and connected to predetermined walls of said cooling jacket.

2. The cylinder block of claim 1 wherein said block is a one-piece casting.

3. The cylinder block of claim 1 wherein both ends of the reinforcing rib are connected to opposing walls of the cooling jacket.

4. The cylinder block of claim 1 wherein said cylinder tubes are substantially axially supported only by said floor section.

5. The cylinder block of claim 1 wherein said cylinder tubes are load bearing.

6. The cylinder block of claim wherein at least one bolt receiving means is formed in said reinforcing rib.

7. The cylinder block of claim 1 wherein said movement restricting means are connected to the cylinder tubes.

8. The cylinder block of claim 1 wherein the width of the reinforcing rib and the wall thickness of a cylinder tube are substantially the same.

9. The cylinder block of claim 8 wherein the depth dimension of said reinforcing rib is substantially greater than the width thereof.

* * * * *

UNITED STATES PATENT AND TRADEMARK OFFICE

CERTIFICATE OF CORRECTION

PATENT NO. : 4,587,933

DATED : May 13, 1986

INVENTOR(S) : Terrence M. Shaw

It is certified that error appears in the above-identified patent and that said Letters Patent is hereby corrected as shown below:

Column 4, line 65, "sti11" should be --still--.

Column 7, claim 6, before "wherein" should be inserted "1".

Signed and Sealed this

*Thirtieth* Day of *September 1986*

[SEAL]

*Attest:*

DONALD J. QUIGG

*Attesting Officer*

*Commissioner of Patents and Trademarks*